US005379564A

United States Patent [19]

Wynne

[11] Patent Number: 5,379,564

[45] Date of Patent: Jan. 10, 1995

[54] SELF-REINFORCING MESH PARTITION

[75] Inventor: Douglas Wynne, Chicago, Ill.

[73] Assignee: Don Wynne Inc., Chicago, Ill.

[21] Appl. No.: 64,406

[22] Filed: May 19, 1993

[51] Int. Cl.[6] ..... E06B 3/70

[52] U.S. Cl. ..... 52/458; 52/818; 256/24; 160/379

[58] Field of Search ..... 160/379, 135; 52/581, 52/584.1, 818, 802, 803, 457, 458; 256/65, 73, 47, 45, 35, 24

[56] References Cited

U.S. PATENT DOCUMENTS

| | | | |
|---|---|---|---|
| 1,164,160 | 12/1915 | Arey | 52/581 |
| 1,251,926 | 1/1918 | Schlesinger | 256/24 |
| 1,385,694 | 7/1921 | McCloud | 52/457 |
| 2,867,857 | 1/1959 | McCarthy | 52/584.1 |
| 3,080,022 | 3/1963 | Mote | 52/584.1 X |
| 3,215,118 | 11/1965 | Behlen | 52/581 X |
| 3,839,834 | 10/1974 | Goddard | 256/24 X |
| 4,526,347 | 7/1985 | McLoughlin | 256/45 X |

OTHER PUBLICATIONS

Brochure entitled "Ford Wire Partitions" (4 pages).
Brochure entitled "WireCrafters" Style 840 Woven Wire Partitions (8 pages), Wire Crafters, Inc. of Louisville, Ky.
Brochure entitled "Folding Guard Wire Partitions" (4 pages).
Brochure entitled "Fence-Gard Welded Wire Partitions and Cages" (4 pages) by Folding Guard Co.

*Primary Examiner*—David M. Purol
*Attorney, Agent, or Firm*—Gerstman, Ellis & McMillin, Ltd.

[57] ABSTRACT

A partition for forming fencing, or cages for warehouses, repair shops and the like, typically comprises a plurality of spaced, vertical posts and at least one mesh wall vertically positioned between the spaced, vertical posts and attached to them. The mesh wall defines a horizontally extending portion extending substantially the length of the mesh wall, with the horizontally extending portion being integral with the mesh wall but bent into transverse relation with the remainder of the vertically positioned mesh wall. The horizontally extending portion stiffens the mesh wall. Preferably the mesh wall defines a pair of such horizontally extending portions, one at the top and one at the bottom of the mesh wall. Also, by this invention a pair of mesh walls may be attached to the vertical posts in vertical relation to each other, being attached to each other by connectors through the horizontally extending portions.

20 Claims, 1 Drawing Sheet

SELF-REINFORCING MESH PARTITION

BACKGROUND OF THE INVENTION

Mesh partitions are commonly used for the construction of security cages in factories, garages and elsewhere, where tools and parts may be inexpensively secured under lock and key. Such mesh partitions may be assembled into cages of desired size, with such products being sold, for example, by the Folding Guard Company of Chicago, Ill., and numerous other companies.

To assemble such a cage from mesh walls, the individual mesh walls are assembled together, typically with horizontal and vertical metal peripheral reinforcements, so that the mesh walls are basically framed on all sides with a rigid, metal reinforcement. Then, the framed mesh walls are attached through the vertical reinforcements to vertical posts which may be typically either attached to the floor or to the wall of a building.

In accordance with this invention, sturdy, reliable enclosures may be made from partitions which comprise one or more mesh walls and which may be generally free of horizontal reinforcing members, which in the prior art are used to provide stiffening to the mesh wall. The mesh wall may also be directly attached to vertical posts without the need of vertical peripheral reinforcements, with the posts being attached to typically the floor, or to a wall if desired.

By this invention, a reliable, sturdy, stiff partition may be provided at a substantial reduction in cost, since the horizontal metal reinforcements are no longer needed to provide the desired stiffening of the mesh wall or walls of this invention. Frequently, the cost of an installed enclosure making use of the partition of this invention can be about half those of the prior art without any significant loss in strength.

DESCRIPTION OF THE INVENTION

By this invention, a partition is provided which can be used to make enclosures, fences or other barriers and walls. The enclosure comprises a plurality of spaced, vertical posts and at least one mesh wall which is vertically positioned between the spaced vertical posts, and attached to the posts. The mesh wall defines a horizontally extending portion which extends substantially the length of the mesh wall and is integral with the mesh wall, but is bent into transverse relation with the remainder of the vertically positioned mesh wall. The horizontally extending portion stiffens the mesh wall to reduce or eliminate the need for other horizontal reinforcing members such as metal track members and the like.

The term "mesh wall" is intended to include wire mesh sheets which comprise crossing wires such as; woven wires, or welded wires where one set of the parallel wire strands are all on one side of another set of parallel wire strands, which sets of strands are at an angle to each other and welded together at their crossing points. Additionally, the term "mesh wall" is intended to include expanded metal sheets or perforated metal sheets, i.e. any typically metal wall which carries an array of apertures.

The horizontally extending portions of the mesh wall are typically of a horizontal width which is much less than the height of the mesh wall. The horizontally extending portion may be produced by simple bending of the appropriate edge of the mesh wall into typically perpendicular relation to the original plane of the mesh wall, although the bending angle does not have to be perpendicular, and other angles will exhibit similar effects, preferably angles that are within 45° of the perpendicular angle.

It is generally preferred for the mesh wall to define a pair of such horizontally extending portions, one at the top and one at the bottom of the mesh wall, although they may alternatively be in a central portion of the mesh wall, if desired, typically as a flattened convolution. Preferably, the mesh wall can have a vertical cross section of a flattened U-shape, flattened because the width of the horizontally extending portions is generally relatively small compared with the remaining vertical height of the mesh wall. Specifically, the preferred width of a horizontally extending portion is less than half of the vertical height of the mesh wall. Such a bent, horizontally extending portion significantly stiffens the mesh wall, to serve as an integral self-reinforcement thereof without the added cost of other horizontal reinforcing members.

Preferably, a pair of the mesh walls may be attached to the vertical posts, with the pair of mesh walls being in vertical relation to each other and attached to each other as an upper mesh wall and a lower mesh wall through horizontally extending portions which are defined by each mesh wall. Thus, a higher partition can be provided, with a horizontally extending portion of each mesh wall being located at a horizontal edge of the mesh wall and attached to another horizontally extending portion by connector means. Specifically the connector means may be something as simple as nuts, bolts, and washers, or special brackets or clips may be used, if desired, to secure the respective mesh walls together.

Thus, by this invention, a strong, self-reinforcing mesh partition can be provided which is preferably free of added horizontal reinforcing members. Instead, bent portions of the mesh wall, typically at the horizontal edges thereof, serve as a self-reinforcement. Also, when two mesh walls are secured together in vertical relation as described above, an added stiffening reinforcement is provided half way up the resulting partition, so that a partition of significant strength and low cost can be provided.

DESCRIPTION OF SPECIFIC EMBODIMENT

Figure 1:
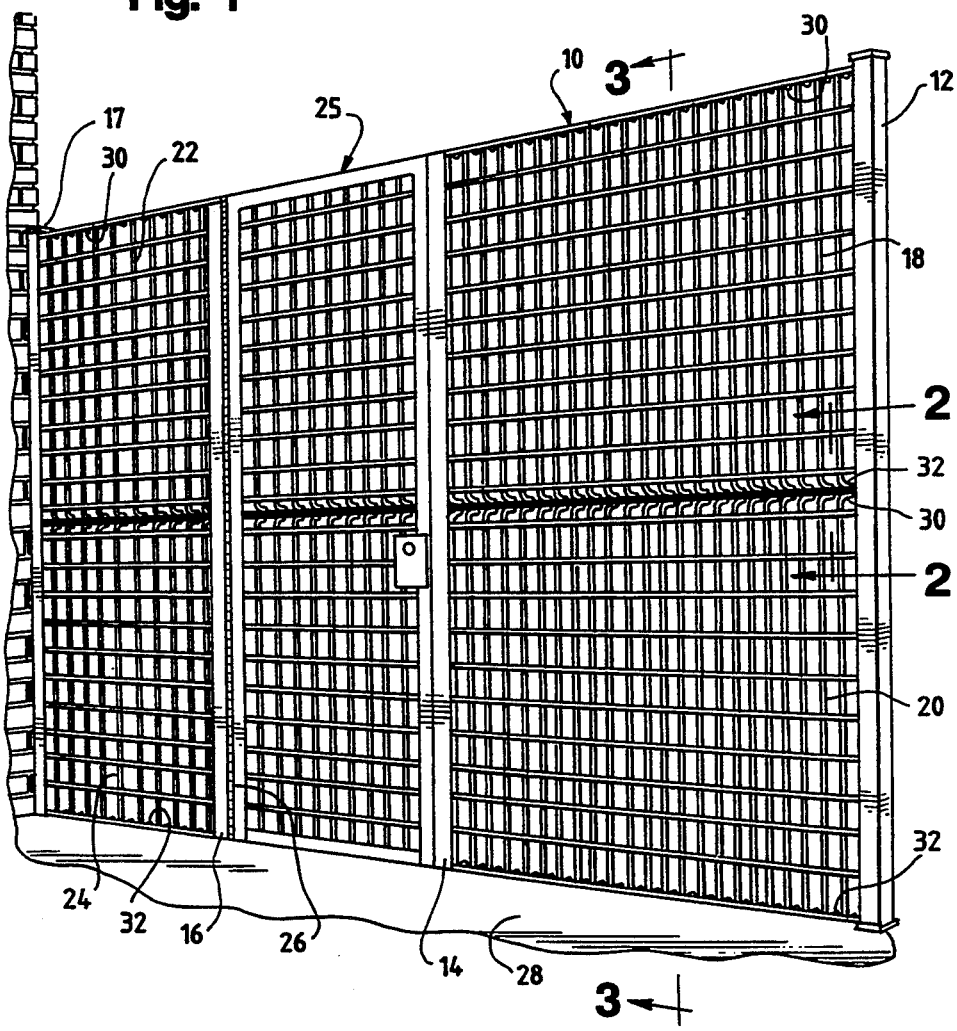
FIG. 1 is a perspective view of a portion of a self-reinforcing mesh partition of this invention.
Figure 3:
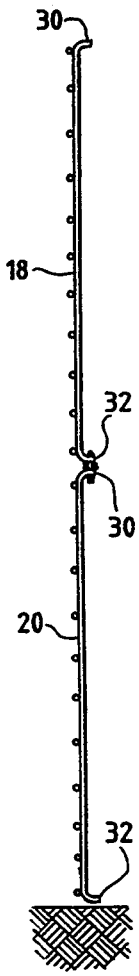
FIG. 3 is a reduced-size transverse sectional view taken along line 3—3 of FIG. 1.

Referring to the drawings, a partition is disclosed, as part of an enclosure in a warehouse or the like, which comprises a plurality of spaced, vertical posts 12, 14, 16, 17. A pair of mesh walls 18, 20 are shown to be vertically positioned between the spaced vertical posts 12, 14, while another pair of mesh walls 22, 24 are positioned between posts 16, 17. A mesh door 25 is provided, of typically conventional construction, between posts 14, 16, being attached to post 16 by hinges 26.

Each of mesh wall portions 18, 20, 22, 24 may be conventionally attached at their lateral edges to the respective posts 12, 14, 16, 17, which posts may be conventionally attached to the floor 28, or driven into the ground in the manner of fence posts, or, in the case of post 17, attached to the wall of the structure in which partition 10 resides. Each of mesh wall portions 18, 20, 22, 24 may be made of 8 gauge wire for example, arranged in a mesh and welded at the respective crossing points of the wire strands.

In accordance with this invention, each mesh wall member 18, 20, 22, 24 defines, in this embodiment, a pair of horizontally extending portions 30, 32, with the respective horizontally extending portions 30, 32 extending the entire length of each of mesh walls 18, 20, 22, 24. Each horizontally extending portion 30, 32 is formed simply by bending the mesh wall, typically after fabrication of the mesh wall, through the use of an appropriate bending die or the like. As shown, the angle of bend of each of horizontally extending portions 30, 32 is essentially 90 degrees to the plane of the rest of mesh walls 18, 20, 22, 24.

As a result of this, each mesh wall exhibits a substantially increased stiffness against horizontal bending. Thus, it can form a strong partition without the need for added horizontal reinforcing members at the top and bottom of the partition, as is required in the prior art. The partition of this invention is substantially less expensive than corresponding partitions of the prior art.

While individual mesh walls may be attached to vertical posts to form their own, exclusive section of the partition, in this particular embodiment a pair of mesh walls, 18, 20 are attached to their vertical posts 12, 14 in vertical relation to each other, with mesh wall 18 being positioned above mesh wall 20. The same relationship applies with respect to mesh walls 22, 24 and vertical posts 16, 17.

Figure 2:
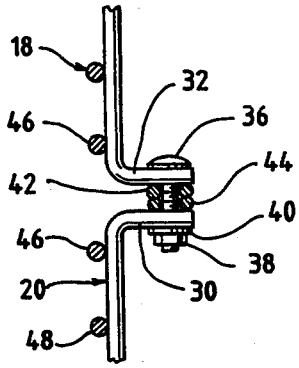
FIG. 2 is an enlarged, sectional view taken along line 2—2 of FIG. 1.

In both cases, as shown by FIG. 2, the bent, horizontally extending portion 32 of mesh wall 18 is connected to the bent, horizontally extending portion 30 of mesh wall 20 by means of a series of connecting bolts 36, nuts 38, and washers 40, distributed along the length of the mesh walls to hold the respective bent, horizontally extending portions 30, 32 together as shown. In this particular embodiment, the respective mesh walls 18, 20 are manufactured with the two horizontal wire strands 42, 44 nearest each edge being spaced closer together than the remainder of the horizontal wire strands as shown. Specifically, strands 42, 44 are spaced about a quarter inch apart, while the spacing between the remaining horizontal strands 42, 46, 48 is about an inch and a half apart. The same bolt connection and strand relationships are also found in the other mesh walls 22, 24.

Thus, partition 10 is strong and highly resistant to bending under horizontal pressure because of the presence of the respective, bent, horizontally extending portions 30, 32. In this particular embodiment it can be seen that there are four such horizontally extending portions 30, 32, two of them being midway up the partition wall.

The above has been offered for illustrative purposes only, and is not intended to limit the scope of the invention of this application, which is as defined in the claims below.

That which is claimed is:

1. A partition which comprises:

a plurality of spaced, vertical posts; at least one mesh wall vertically positioned between said spaced, vertical posts and attached thereto, said mesh wall comprising strands and defining a horizontally extending mesh portion extending substantially the length of said mesh wall, with strands of said horizontally extending portion being integral with strands of the remainder of said mesh wall but bent into transverse relation with the remainder of said mesh wall, whereby said horizontally extending portion stiffens said mesh wall.

2. The partition of claim 1 in which said mesh wall defines a pair of said horizontally extending portions, one at the top and one at the bottom of said mesh wall.

3. The partition of claim 2 in which said mesh wall has a vertical cross section of a flattened U-shape.

4. The partition of claim 1 in which the width of the horizontally extending portion is less than half the vertical height of said mesh wall.

5. The partition of claim 1 in which a pair of said mesh walls is attached to said vertical posts in vertical relation to each other, and attached to each other by connector means through said horizontally extending portions defined by each mesh wall, each said horizontally extending portion of each mesh wall being located at a horizontal edge of said mesh wall.

6. The partition of claim 1 in which said mesh wall is substantially free of added, horizontal reinforcing members.

7. The partition of claim 1 in which said mesh wall comprises crossing wires.

8. A partition which comprises:

a plurality of spaced, vertical posts; at least one mesh wall vertically positioned between said spaced, vertical posts and attached thereto, said mesh wall comprising strands and defining a horizontally extending portion extending substantially the length of said mesh wall, with strands of said horizontally extending portion being integral with stands of the remainder of said mesh wall but bent into transverse relation with the remainder of said mesh wall, whereby said horizontally extending portion stiffens said mesh wall, said mesh wall defining a pair of said horizontally extending portions, one at the top and one at the bottom of said mesh wall, said mesh wall being substantially free of added, horizontal reinforcing members.

9. The partition of claim 8 in which said mesh wall has a vertical cross-section of a flattened U-shape.

10. The partition of claim 9 in which the width of the horizontally extending portion is less than half the vertical height of said mesh wall.

11. The partition of claim 10 in which a pair of said mesh walls are attached to said vertical posts in vertical relation to each other, and attached to each other through said horizontally extending portions defined by each mesh wall, each said horizontally extending portion of each mesh wall being located at a horizontal edge of said mesh wall, a horizontally extending portion of each mesh wall being attached to a horizontally extending portion of the other mesh wall by connector means.

12. The partition of claim 11 in which said mesh wall comprises crossing wires.

13. A partition which comprises a mesh wall, said mesh wall defining a transverse mesh portion extending substantially the length of said mesh wall, said transverse mesh portion having strands which are integral with strands of the remainder of said mesh wall but bent into transverse relation with the remainder of said mesh wall, whereby said transverse mesh portion stiffens said mesh wall.

14. The partition of claim 13 in which said mesh wall defines a pair of said transverse mesh portions, one at the top and one at the bottom of said mesh wall.

15. The partition of claim 14 in which said mesh wall has a cross section of a flattened U-shape.

16. The partition of claim 13 in which a pair of said mesh walls are positioned in vertical relation to each other, and attached to each other by connector means through said transverse mesh portions defined by each mesh wall.

17. The partition of claim 13 in which said mesh wall is substantially free of added, horizontal reinforcing members.

18. The partition of claim 17 in which said mesh wall comprises crossing wires.

19. The partition of claim 13 in which said mesh wall comprises crossing wires.

20. The partition of claim 19 in which said mesh wall defines a pair of said transverse mesh portions on opposed sides of said mesh wall.

* * * * *